United States Patent [19]

Sogoh

[11] 4,333,375

[45] Jun. 8, 1982

[54] ELECTRONIC MUSICAL INSTRUMENT HAVING TIME MULTIPLEXED KEYING SYSTEM

[75] Inventor: Kiyoshi Sogoh, Hamamatsu, Japan

[73] Assignee: Nihon-Hammond Kabushiki Kaisha, Osaka, Japan

[21] Appl. No.: 144,070

[22] Filed: Apr. 28, 1980

[30] Foreign Application Priority Data

| | | | |
|---|---|---|---|
| May 2, 1979 | [JP] | Japan | 54-54338 |
| Nov. 14, 1979 | [JP] | Japan | 54-54336 |
| Nov. 14, 1979 | [JP] | Japan | 54-54337 |
| Nov. 14, 1979 | [JP] | Japan | 54-86319 |

[51] Int. Cl.[3] ..... G10H 1/00

[52] U.S. Cl. ..... 84/1.01; 84/1.22

[58] Field of Search ..... 84/1.01, 1.03, 1.19, 84/1.22, 1.23

[56] References Cited

U.S. PATENT DOCUMENTS

| | | | |
|---|---|---|---|
| 3,916,750 | 11/1975 | Uetrecht | 84/1.01 |
| 4,134,321 | 1/1979 | Woron | 84/1.22 |
| 4,189,970 | 2/1980 | Woron | 84/1.19 |

*Primary Examiner*—J. V. Truhe
*Assistant Examiner*—Forester W. Isen
*Attorney, Agent, or Firm*—Neuman, Williams, Anderson & Olson

[57] ABSTRACT

A keying system for an electronic musical instrument incorporates time division multiplexing of the individual frequency component signals which are combined to synthesize musical notes or tones. A signal generator provides the fundamental and various harmonic frequency signals which are applied to a plurality of multiplexer circuits corresponding in number to the number of keys on the keyboard of the musical instrument. Activation of a key connects the multiplexer output signals from a corresponding one of the multiplexer circuits to a demultiplexer circuit on a common bus. Time slot signals control the multiplexers and demultiplexer to generate the desired tones corresponding to activated keys.

8 Claims, 6 Drawing Figures

ELECTRONIC MUSICAL INSTRUMENT HAVING TIME MULTIPLEXED KEYING SYSTEM

BACKGROUND OF THE INVENTION

This invention is directed to a keying system for electronic musical instruments and more particularly to a time division multiplexed keying system for an electronic organ.

The synthesis electronic organ is based upon the knowledge that sustained complex musical tones can be synthesized by mixing properly scaled sine waves having frequencies representative of the fundamental and the various harmonics of the tones to be synthesized. This is done by having each organ playing key operate a group of contacts such that when the playing key is pressed it connects sine wave generators corresponding to the various frequencies required to a corresponding group of busses. By connecting the various busses to the output through voltage divider resistors or transformer primary taps the relative strength of the various harmonics is adjusted as desired. Usually nine separate contacts for each of the playing keys are necessary in such synthesis organs. This multiple contact keying system is referred to as alternating current (AC) keying.

The multiple contacts of the individual playing keys in the synthesis electronic organ create various problems. For example, they tend to be somewhat stiff and accordingly present a greater mechanical resistance to the depression of an individual key than is desirable for some organists. Also, AC keying requires that low level signals be passed directly through each contact and, accordingly, the contacts must be of a very high quality and hence expensive. Keying transients are difficult to control and there are also limitations on control of the keying envelope.

Due to the problems encountered with AC keying, direct current (DC) keying has been developed. In DC keying of a synthesis organ, a single contact key passes a direct current signal to control a plurality of transistor switches. These switches connect the various frequencies required for a given tone to filter circuits which are in turn connected to audio output circuits to sound the desired tone. An example of this type of DC keying system is disclosed in U.S. Pat. No. 3,636,231.

In the interest of simplifying electronic organ circuits and reducing the amount of interconnections and circuitry required therein, various time division multiplexing arrangements have been developed. For example, in one system the various control signals from the draw bars and tabs are multiplexed and applied in multiplex form to a DC keyer while each group of signals from the keyboard manuals are multiplexed and applied to the DC keyer in synchronism with the multiplexed control signals. This known time multiplexed arrangement receives the various tone signal inputs unmultiplexed, applied multiplexed signals from the draw bars and keyboards to generate time multiplexed output signals which are correspondingly demultiplexed and applied to output filter circuits. Still other systems provide for multiplexing keydown signals from the organ keyboard to eliminate the wiring otherwise required to connect the keyboard to the tone generating and sounding circuitry.

SUMMARY OF THE INVENTION

The present invention utilizes time division multiplexing circuitry to reduce the amount of interconnections and circuitry required in electronic synthesis organs and at the same time eliminates the multiple contacts required by AC keying systems. In the keying system in accordance with the present invention, a signal generator provides the fundamental and the various harmonic frequency signals of the individual tones or notes. These frequency signals are applied to a plurality of multiplexer circuits corresponding in number to the number of keys on the keyboard or organ manual of the synthesis organ. The depression of each key on the keyboard connects the output from a corresponding one of the plurality of multiplexer circuits to a demultiplexer circuit on a common bus. A time slot generating circuit controls the plurality of multiplexer circuits and the demultiplexer circuit for generating tone signals corresponding to the desired output signals indicated by activated keys on the keyboard.

Control signals for tabs, draw bars, signal levels etc. which are not directly associated with the organ keying function, are passed through the multiplexer circuits, the demultiplexer circuit and the keyboard to reduce the amount of circuitry and interconnections which would otherwise be required.

The signal to noise ratio of the output signals from the keying system is improved by connecting a source of potential through the keyboard contacts to directly control the multiplexer circuits. For such direct control, the multiplexed tone signals do not pass through the keyboard key contacts. Envelope generating circuitry is also provided to impose keying envelope signals onto the time division multiplexed output signals from the keying system. The envelope circuitry is directly activated by the keyboard contacts to similarly reduce the signal to noise ratio of the output signals.

When more than one keyboard manual is required for the synthesis organ, only the manual and an additional demultiplexer need to be added to the keyer system.

Time division multiplexer techniques can be employed to apply differing keying envelope signals to individual frequency components of a tone to be generated to accomplish special effects, e.g., a strike tone or percussive effect.

BRIEF DESCRIPTION OF THE DRAWING

The invention will be better understood from the detailed description of illustrative embodiments when read with reference to the drawing in which.

DETAILED DESCRIPTION OF ILLUSTRATIVE EMBODIMENTS

Figure 1:
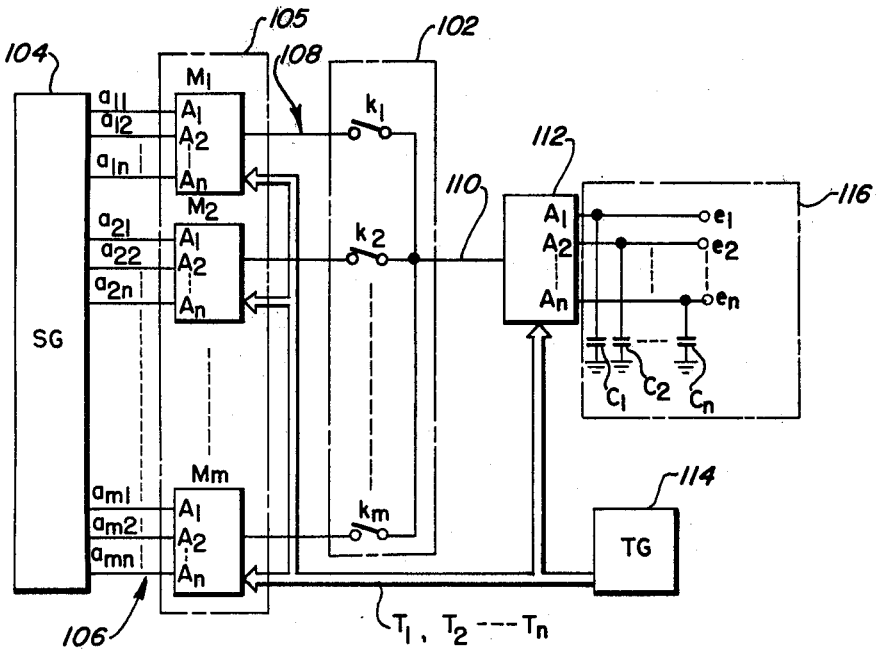
FIG. 1 is a schematic diagram of a basic time division multiplexed keying system in accordance with the present invention.

Referring to FIG. 1 of the drawing, a schematic diagram of a time division multiplex keying system for an electronic organ having a single manual 102 is disclosed. A signal generator 104 generates all the frequency signals necessary for the synthesis of the desired tones. These are provided on the conductors 106 and represented as $a_{11}$ through $a_{mn}$. The subscripts on the individual conductors provided by the signal generator 104 indicate that there are m keys with each key being able to provide n individual frequency component signals for the tone which is synthesized in response to its activation. It will be understood that various frequency signals required by the multiplexers are identical to one another. Accordingly, only one signal of each required frequency is generated by the signal generator 104 and all multiplexers requiring that frequency and provided with the same signal. For example, the 440 hertz signal on one of the conductors 106 supplies the fundamental frequency of 440 hertz for the letter note A while also supplying the second harmonic frequency for the letter note A an octave lower, the fourth harmonic frequency for the letter note A two octaves lower and so on. This general practice of multiple use of frequency signals from a common signal generator is well understood and a common procedure in synthesis organs and accordingly will not be discussed further herein.

A group of multiplexer circuits 105 receives the frequency signals from the signal generator 104 and provides multiplexed output signals on the conductors 108 to the keyboard 102. The group circuit 105 includes a plurality of individual multiplexer circuits $M_1$ through $M_m$.

Each of the multiplexer circuits $M_1$ through $M_m$ is associated with one of the individual keys $K_1$ through $K_m$ of the keyboard 102. Each multiplexer circuit receives the n frequency signals on the conductors 106 from the signal generator 104 corresponding to the fundamental and the various harmonics required for the note which corresponds to the associated key. The output of each multiplexer is connected to one side of its associated key via the conductors 108. The opposite sides of the keys $K_1$ through $K_m$ are connected together to the conductor 110. Time division multiplex signals passing through any depressed keys are applied via conductor 110 to a demultiplexer circuit 112.

A time slot generator 114 generates various clocking or time slot signals $T_1$ through $T_n$ which activate the time division multiplexer circuits $M_1$ through $M_m$ and the demultiplexer circuit 112. The output signals from the demultiplexer 112 are provided to an output circuit 116. The output circuit 116 includes a plurality of capacitors $C_1$ through $C_N$ which hold or integrate the demultiplexed output signals to provide corresponding analog signals on the plurality of output terminals $e_1$ through $e_n$.

Operation of the time division multiplex keying system of FIG. 1 is as follows. The various signals including the fundamental and the selected harmonics corresponding to a particular key on keyboard 102 are respectively provided to each multiplexer $M_1$ through $M_m$. When a selected key is activated such as $K_1$, the corresponding time division multiplexed signals at the output of multiplexer $M_1$ on its associated one of the conductors 108 are passed through the key $K_1$ to the conductor 110 and the demultiplexer 112. During time slot 1 the frequency signals provided on the input terminals $A_1$ of all the multiplexers are passed to their output terminals which are connected to the conductors 108. Any keys which are depressed during time slot 1 pass those signals during that time slot to the output conductor 110. The demultiplexer 112 is enabled at that time to pass those signals to the demultiplexer output $A_1$. Similar connections are made during time slots $T_2$ through $T_n$ such that samples of each of the n frequency signals corresponding to each key are passed to the demultiplexer 112. The multiplexers $M_1$ through $M_m$ and the demultiplexer 112 are controlled by time slot generator 114. The demultiplexed signals go to the output circuit 116. The repetitive frequency of the time slots which control the multiplexers $M_1$ through $M_m$ and the demultiplexer 112 is so rapid that numerous samples of each of the frequency signals are provided to the output circuit 116 for even the shortest activation of any of the keys of the manual 102. Thus, by utilizing readily available integated circuits for time division multiplexing and demultiplexing the frequency signals for the individual keys of a synthesis electronic organ manual, an inexpensive keying system is provided which eliminates the multiple contacts previously required in AC keying systems and overcomes the disadvantages associated therewith.

Figure 2:
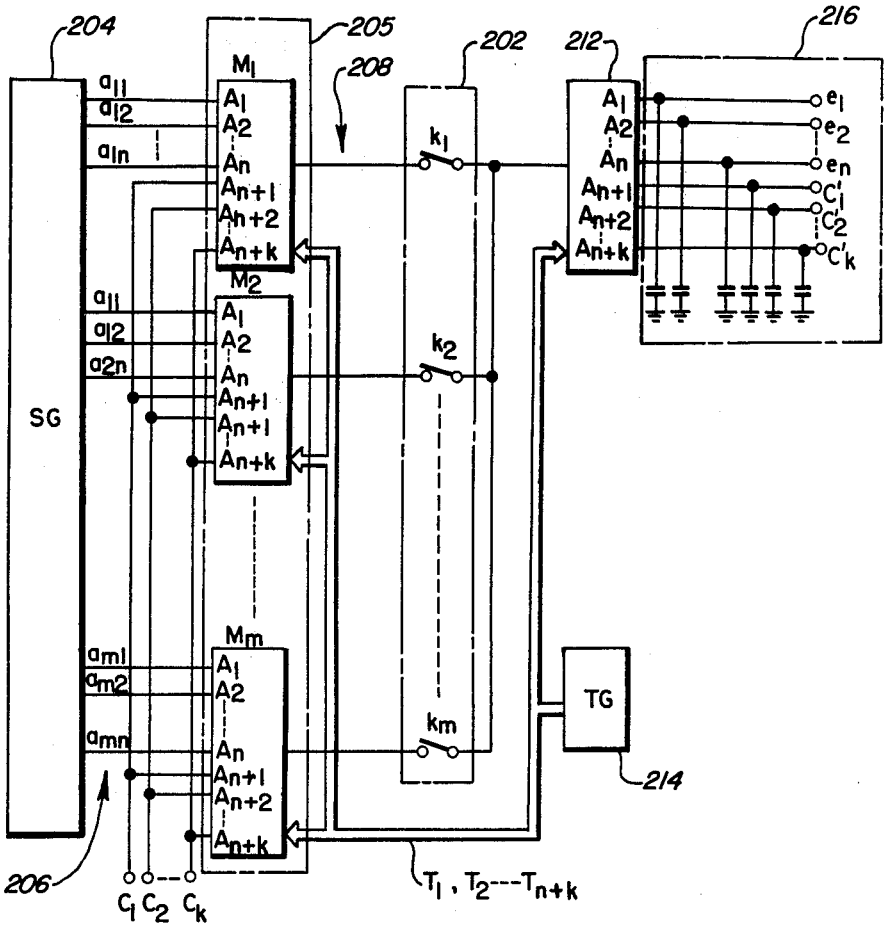
FIG. 2 is a schematic diagram of a time division multiplexed keying system wherein control signals are passed through the keying system together with the individual frequency tone signals.

FIG. 2 is a schematic diagram of a time division multiplexed keying system in accordance with the present invention wherein various organ control signals which are not involved with the keying system per se are passed through the keying system. Corresponding circuit components are numbered the same as in FIG. 1 except in the two hundred series of numbers. Additional time slots are provided by the time slot generator 214 to control each of the multiplexers $M_1$ through $M_m$ and the demultiplexer 212. The time slot generator 214 provides time slots $T_1$ through $T_n+k$ to provide for passing the control signals through the keying system.

Control signals can be passed in a forward direction, i.e., in the same direction as the frequency signals generated by the tone generator 204, such that control signals are passed from the terminals $C_1$ through $C_k$ to the terminals $C'_1$ through $C'_k$ which are part of output circuit 216. Similarly, control signals can be passed in a reverse direction through the keying system from terminal $C'_1$ through $C'_k$ to terminals $C_1$ through $C_k$. Control signals are passed in a forward direction through the keying system for example to control the envelope signal desired, vibrato, etc. Control signals are passed in a reverse direction through the keying system for example to control the levels of the tones generated by the signal generator 204. It is also noted that a single control signal can be distributed to a plurality of locations for control signals transmitted in a reverse direction through the keying system. By connecting all of the terminals $C_1$ through $C_k$ to the terminals in the multiplexer $M_1$ through $M_m$ which correspond to a single time slot by connecting the control signal to the corresponding time slot terminal of the output circuit 116. The control signal is passed to all of the terminals $C_1$ through $C_k$ during the single selected time slot. Such control signal connections can provide for convenient signal distribution in an electronic organ.

Figure 3:
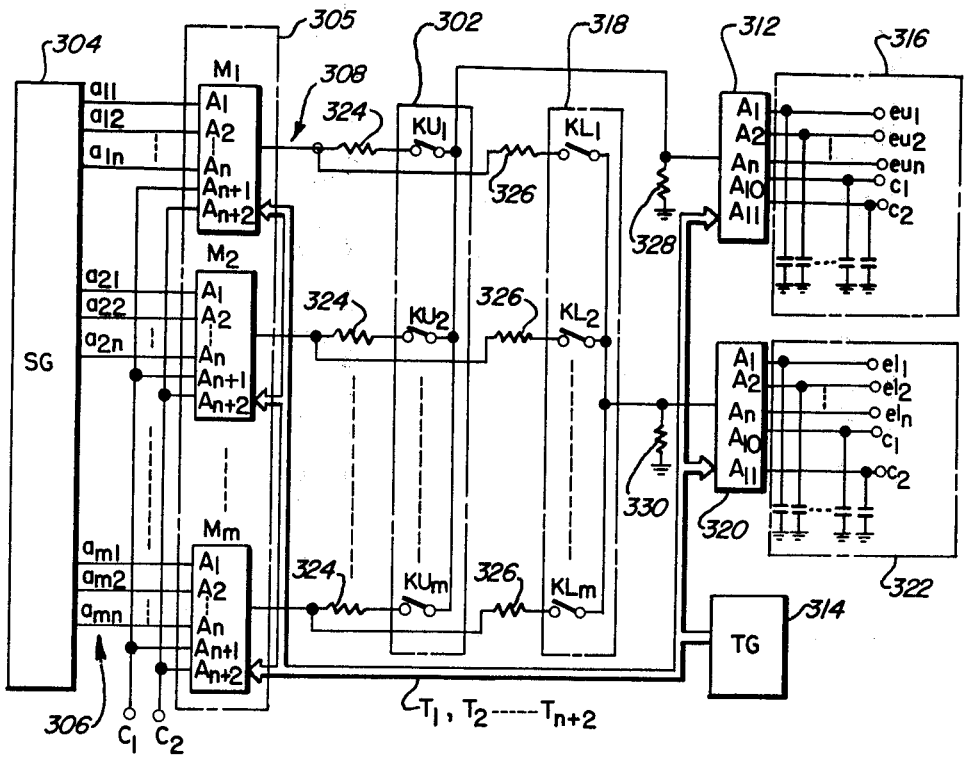
FIG. 3 is a schematic diagram of a time division multiplexed keying system having two manuals and control signals passed through the keying system.

FIG. 3 shows a schematic diagram of a keying system in accordance with the present invention wherein a second manual 318 is provided. Corresponding circuit components are numbered the same as in FIGS. 1 and 2 except in the three hundred series of numbers.

It is noted that the addition of the second manual 318 does not require a similar addition of multiplexer circuits over and above the multiplexers $M_1$ through $M_m$ of multiplexer circuit block 205 since corresponding frequency signals are provided to both the first manual 302 and the added second manual 318. If the notes keyed by the two manuals do not correspond in frequency as is the case in some organs, additional multiplexer circuits may be required. However, the number of additional multiplexers required would correspond to the number of nonoverlapping keys. The addition of the second manual 318 does require an additional demultiplexer circuit 320 and a corresponding output circuit 322 such that the output signals keyed by the second manual are directed to corresponding output circuitry connected to the terminals $e1_1$ through $e1_n$ of the output circuit 322. The additional demultiplexer 320 is driven by the time slot signals generated by the time slot generator 314 in the same manner as the first demultiplexer 312.

In the keying system of FIG. 3 only two control signals are shown as passing through the keying system. These control signals are provided on the terminals $C_1$ and $C_2$ to be distributed to the terminals $C'_1$, $C'_2$ and $C''_1$, $C''_2$ during time slots $T_{n+1}$ and $T_{n+2}$, respectively. The time slots $T_{n+1}$ and $T_{n+2}$ being added for the control signals and generated by the time slot signal generator 314 as discussed above with reference to FIG. 2. With the addition of the second demultiplexer 320, a control signal input to the multiplexers $M_1$ through $M_m$ can be distributed to the separate output locations, one in the output circuit 316 and the other in the output circuit 322. As previously described, a single time slot can be used for control signal distribution. Control signals can be sent from the output circuits 316 and 322 to the terminals $C_1$ and $C_2$ via the keying system to, for example, control the relative signal levels of the signals generated by the first and second or upper and lower manuals. These reverse signals can be controlled at either of the demultiplexers 316 or 322 via the terminals $C'_1$, $C'_2$ or $C''_1$, $C''_2$, or signals can be provided at both demultiplexers and combined. Alternate signaling variations will be apparent to those of ordinary skill in the art.

In the keying system of FIG. 3 the multiplexed signals are added at the load resistors 328 and 330 in combination with the individual keying resistors 324 associated with activated keys of the manual 302 and the individual keying resistors 326 associated with activated keys of the manual 318. The individual keying resistors and load resistors have been omitted from the other figures for simplicity of description. It is noted that the individual keying resistors are important for providing the proper output impedance for the multiplexer circuits of the keying systems of all figures.

Figure 4:
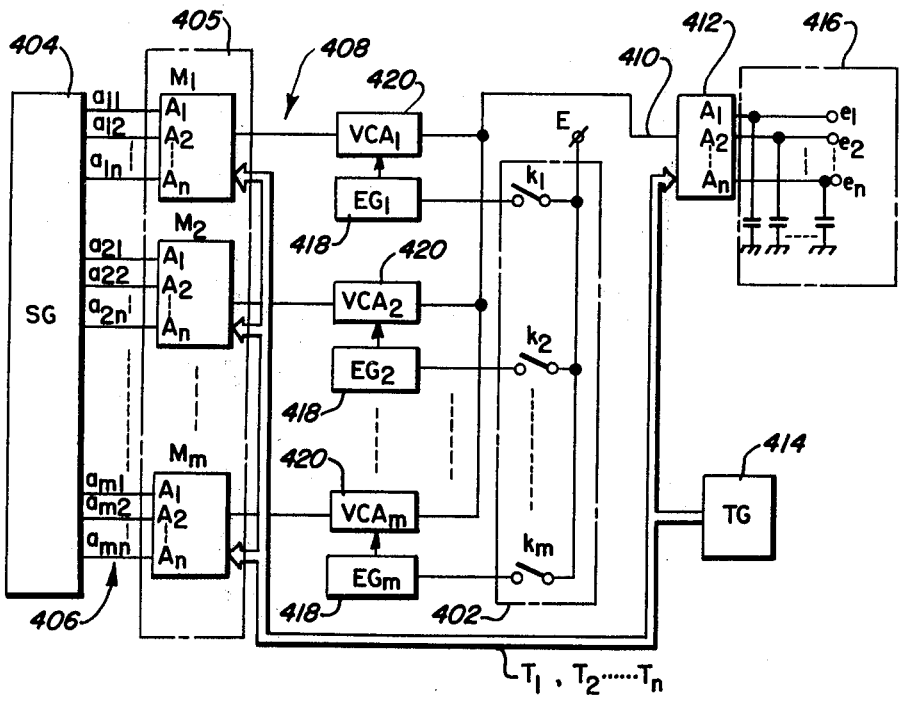
FIG. 4 is a schematic diagram of a time division multiplexed keying system wherein the manual keys drive envelope generator circuits to generate the desired tones.

The keying system of FIG. 4 incorporates a manual 402 wherein the individual key contacts are used to drive envelope generator circuits 418. Corresponding circuit components are numbered the same as in preceding Figs. except in the four hundred series of numbers. An envelope generator circuit 418 is associated with each key $K_1$ through $K_m$ of the manual 402 and an associated one of the voltage controlled amplifiers 420. The envelope generator circuits 418 and voltage controlled amplifiers 420 serve to modulate the time division multiplexed signals with an envelope signal to control the attack and delay times for tones generated by the organ. In this arrangement, the multiplexed frequency signals are not connected through the keyboard contacts and thus the keying arrangement of FIG. 4 provides a better signal-to-noise ratio for the output signals provided to the output circuit 416. It is noted that the configuration of the manual 402 could be used in the keying system of FIG. 1 to similarly improve the signal-to-noise ratio of the output signals delivered to the output circuit 116. For that modification, the conductors 108 would be connected together and to the conductor 110 and the contacts of the manual 402 would be used to directly control enable circuitry provided in commonly available multiplexer circuits.

Figure 5:
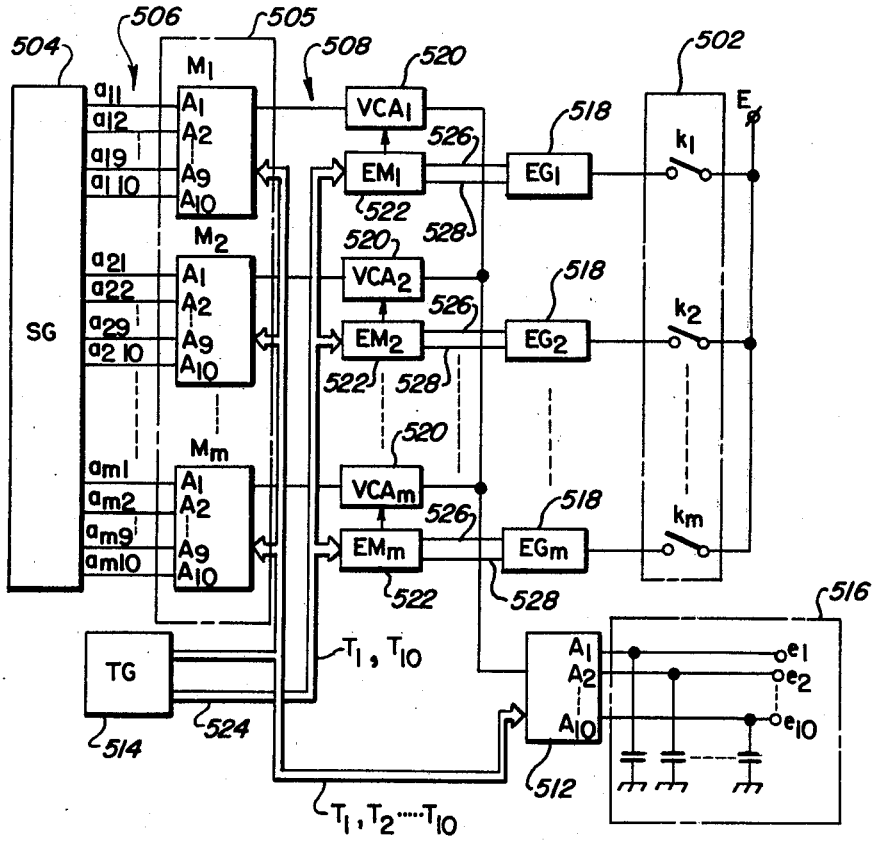
FIG. 5 is a schematic diagram of a time division multiplexed keying system in accordance with the present invention wherein alternate envelope signals are provided for the various frequency signals on a time division multiplexed basis.

FIG. 5 is a schematic diagram of a time multiplexed keying system wherein multiple envelope signals are provided by the envelope generators 518 and those multiple envelope signals are time division multiplexed by the envelope multiplexer circuits 522. Corresponding circuit components in FIG. 5 are numbered the same as in the preceding Figs. except in the five hundred number series. In the keying system shown in FIG. 5, ten time slots are provided by time slot signals generated by the time slot generator 514. The time slot signals are provided to the multiplexers $M_1$ through $M_m$ and to the demultiplexer circuit 512. Time slot signals are also provided to the envelope multiplexers 522 via the bus 524. Here again, as in FIG. 4, the time division multiplexed output signals flow directly into the demultiplexer 512 and do not pass through the individual key contacts of the manual 502.

In the keying system of FIG. 5 ten frequency signals are passed from the signal generator 504 via the conductors 506 to each of the multiplexer circuits $M_1$ through $M_m$ of the multiplexer block 505. Nine of the frequency signals define the fundamental and various harmonics of the tone to be generated by the corresponding key. The tenth frequency signal is a duplicate of one of the preceding nine frequency signals and is used to provide a strike tone or percussive effect. The strike tone is generated by modulating the first nine frequency signals with a sustain envelope signal and modulating the tenth frequency signal with a percussion envelope signal. This technique is explained with reference to FIG. 6 which shows various waveforms for the description of the operation of the keying system of FIG. 5.

Figure 6:
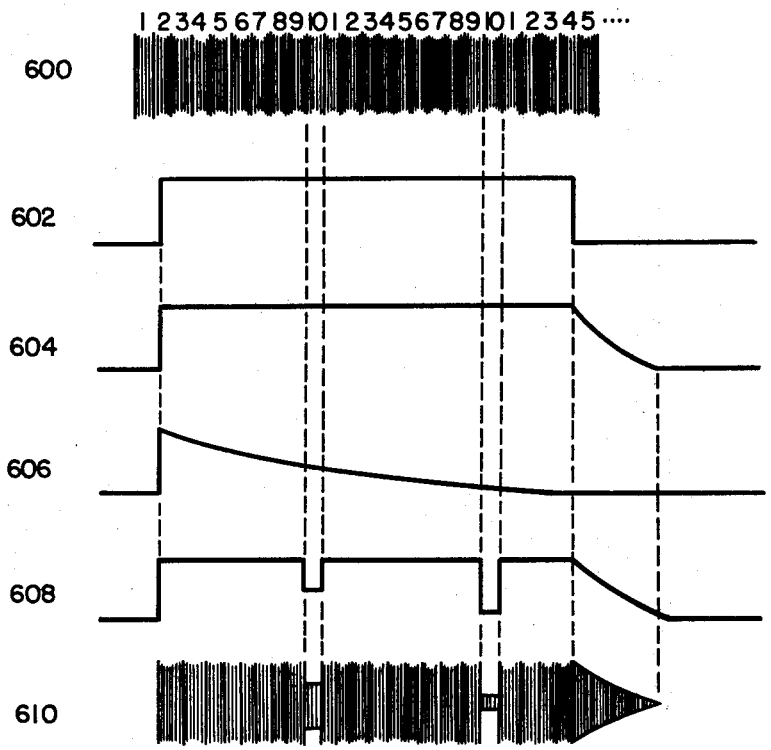
FIG. 6 shows waveforms for the description of the operation of the keying system of FIG. 5.

Waveform 600 of FIG. 6 illustrates the various tone signals which are provided during the sequentially occurring ten time slots 1 through 10. Waveform 602 shows a key generated input signal from one of the keys in the manual 502 which input signal is provided to one of the envelope generators 518. Each of the envelope generators 518 generates two envelope signals on the output conductors 526 and 528 which are connected to the respective envelope multiplexing circuits 522. Waveforms 604 and 606 of FIG. 6 are representative of a sustain envelope signal and a percussion envelope signal, respectively, as generated by the envelope generators 518 on the conductors 526 and 528.

The envelope multiplexer circuits 522 apply the sustain envelope signal 604 to the time multiplexed signals for the first nine time slots which correspond to the fundamental and the selected harmonics of a selected tone. However, for the tenth time slot which corresponds to the rapidly decaying or percussed frequency component (typically the third harmonic of the fundamental) the percussion envelope signal 606 is used. The waveform 608 is representative of the intermixing or multiplexing of the two envelope signals 604 and 606 to control the voltage controlled amplifiers 520 for a key which is depressed. The waveform 610 correspondingly represents the output signal which is passed to the demultiplexer 512. It is noted that these waveforms are drawn to conceptionally show the envelope signals which are multiplexed to modulate the time slots 1 through 9 and the time slot 10, respectively. The time slots 1 through 10 actually occur much more frequently than indicated in FIG. 6 and it is noted that a single sequence of time slots would not result in such large changes in the envelope signals as illustrated in FIG. 6.

Multiplexing the envelope signals as described above generates a strike tone or percussion effect by modulating one of the harmonic frequency signals for a given note with a percussion envelope signal. This musical effect is well-known in the art of electronic organs. It is to be noted that additional time slots can be provided and that additional frequency signals can be selected to be modulated by either a percussion envelope signal or other alternate envelope signals to provide special effects to enhance the output signals of an organ incorporating the keying system of the present invention.

As is apparent from the above description, the time division multiplexed keying systems in accordance with the present invention, provide highly efficient keying systems which eliminate the multiple contacts required for AC keying and reduce the amount of circuitry and interconnections required in an electronic synthesis organ. Control signals can be passed in either direction through the keying system to further reduce the wiring required. Special effets, e.g., percussive effects can be accomplished through the provision of multiplexed keying envelope signals in conjunction with the multiplexed keying systems.

While various illustrative embodiments of this invention have been described, it will be understood that the invention is not limited to those embodiments. In view of the foregoing teachings, modifications will be apparent to those of ordinary skill in the art to which this invention pertains. Therefore, the appended claims are intended to cover any modifications and any other embodiments which constitute the salient features within the true spirit and scope of this invention.

What is claimed:

1. A synthesis electronic organ having a signal generator for generating a multiplicity of tone signals corresponding to the fundamentals and desired harmonics of notes to be synthesized, at least one keyboard having a plurality of single contact keys and a time division multiplexed keying system, said keying system comprising: a plurality of time division multiplexer circuits corresponding in number to said plurality of keys, each of said multiplexer circuits having a plurality of input terminals connected to receive selected ones of said tone signals and an output terminal; a first time division demultiplexer circuit having an input terminal and a plurality of output terminals corresponding in number to said plurality of input terminals of said multiplexer circuits; first conductor means for interconnecting said plurality of keys individually to said multiplexer circuits and in common to said first demultiplexer input terminal; and a time slot signal generator for generating time slot signals to control said plurality of multiplexer circuits and said demultiplexer circuit in synchronism.

2. The synthesis electronic organ of claim 1 wherein said first conductor means comprises a plurality of first resistors for connecting said multiplexer circuits to said keys and a second resistor for connecting the input of said first demultiplexer circuit to a defined potential.

3. The synthesis electronic organ of claim 1 further comprising: a second keyboard comprising a plurality of single contact keys; a second time division demultiplexer circuit having an input terminal and a plurality of output terminals corresponding in number to said plurality of input terminals of said multiplexer circuits; and second conductor means for interconnecting said plurality of keys individually to said multiplexer circuits and in common to said second demultiplexer input terminal, said second demultiplexer being responsive to said time slot signals for synchronous operation with said plurality of multiplexer circuits.

4. The synthesis electronic organ of claim 1 or 3 wherein said multiplexer circuits each comprise a plurality of input terminals greater in number than the tone signals to be multiplexed by each of said multiplexer circuits whereby control signals can be transmitted through said keying system.

5. The synthesis electronic organ of claim 3 wherein said first conductor means comprises a plurality of first resistors for connecting said multiplexer circuits to said keys of one of said keyboards and a second resistor for connecting the input of said first demultiplexer circuit to a defined potential; and, said second conductor means comprises a plurality of third resistors for connecting said multiplexer circuits to said keys of said second keyboard and a fourth resistor for connecting the input of said second demultiplexer to a defined potential.

6. In an electronic organ having a source of potential and a signal generator for generating multiple tone signals corresponding to the fundamentals and desired harmonics of notes to be sounded by said organ, a time division multiplexed keying system comprising:

a keyboard comprising a plurality of single contact keys, each of said keys being connected to said source of potential for generating a key down signal in response to being activated;

a plurality of multiplexer circuits corresponding in number to said plurality of keys, each of said multiplexer circuits comprising a plurality of input terminals connected to said signal generator for receiving selected ones of said tone signals and an output terminal;

a demultiplexer circuit having an input terminal and a plurality of output terminals corresponding in number to said plurality of input terminals of each of said multiplexer circuits;

time slot generator means for generating time slot signals to control said plurality of multiplexer circuits and said demultiplexer circuit in synchronism; and connecting means for connecting said output terminals of said multiplexer circuits to said plurality of keys and to said input terminal of said demultiplexer.

7. The keying system of claim 6 wherein said connecting means comprises:

a plurality of voltage controlled amplifiers corresponding in number to said plurality of multiplexers, each of said amplifiers having a signal input terminal connected to the output terminal of one of said multiplexer circuits, a signal output terminal connected to said input terminal of said demultiplexer circuit, and a control input terminal; and a plurality of envelope generator circuits each having an input terminal connected to respective ones of said keys and an output terminal connected to said control terminal of the corresponding voltage controlled amplifier.

8. The keying system of claim 6 further comprising:

a plurality of voltage controlled amplifiers corresponding in number to said plurality of multiplexers, each of said amplifiers having a signal input terminal connected to the output terminal of one of said multiplexer circuits, a signal output terminal connected to said input terminal of said demultiplexer circuit and a control input terminal;

a plurality of envelope generator circuits each having an input terminal connected to respective ones of said keys and a plurality of output terminals; and a plurality of envelope multiplexing circuits each having an output terminal connected individually to said control input terminal of said voltage controlled amplifiers, a timing input terminal connected to said time slot generator means and a plurality of input terminals individually connected to said output terminals of one of said plurality of envelope generator circuits whereby said envelope generator circuits generate at least two envelope signals at said plurality of output terminals and the time multiplexed signals from said multiplexer circuits are modulated by at least one of said two envelope signals.

* * * * *